US007958728B2

(12) United States Patent
Dumas et al.

(10) Patent No.: US 7,958,728 B2
(45) Date of Patent: Jun. 14, 2011

(54) DEVICE FOR TURBOCHARGING AN INTERNAL COMBUSTING ENGINE COMPRISING A PULSATION DAMPING CHAMBER

(75) Inventors: Eric Dumas, Houilles (FR); Frédéric Everard, Domont (FR); Gérard Stefani, Le Blanc Mesnil (FR)

(73) Assignee: RENAULT s.a.s., Boulogne Billancourt (FR)

( * ) Notice: Subject to any disclaimer, the term of this patent is extended or adjusted under 35 U.S.C. 154(b) by 790 days.

(21) Appl. No.: 11/814,759

(22) PCT Filed: Jan. 23, 2006

(86) PCT No.: PCT/FR2006/050042

§ 371 (c)(1),
(2), (4) Date: Feb. 15, 2008

(87) PCT Pub. No.: WO2006/079738

PCT Pub. Date: Aug. 3, 2006

(65) Prior Publication Data

US 2008/0184705 A1 Aug. 7, 2008

(30) Foreign Application Priority Data

Jan. 25, 2005 (FR) ..... 05 00756

(51) Int. Cl.
*F02B 33/44* (2006.01)
*F04D 29/66* (2006.01)
*F01N 1/02* (2006.01)

(52) U.S. Cl. ..... 60/605.1; 415/119; 181/249

(58) Field of Classification Search ..... 60/605.1; 415/119; 181/249, 243, 232, 272; *F04D 29/66, F04D 29/68; F02B 37/00*

See application file for complete search history.

(56) References Cited

U.S. PATENT DOCUMENTS

| | | | | |
|---|---|---|---|---|
| 1,663,998 | A * | 3/1928 | Schmidt | 415/211.2 |
| 3,398,932 | A * | 8/1968 | Koeller et al. | 415/119 |
| 4,735,178 | A | 4/1988 | Inoue et al. | 60/605.1 |
| 5,316,439 | A * | 5/1994 | Gatley et al. | 415/119 |
| 6,253,873 | B1 * | 7/2001 | Norres et al. | 181/224 |
| 7,128,095 | B2 * | 10/2006 | Hayashi | 138/30 |
| 2003/0085071 | A1 * | 5/2003 | Boast et al. | 181/249 |
| 2008/0286127 | A1 * | 11/2008 | Gaude et al. | 417/312 |
| 2008/0292449 | A1 * | 11/2008 | Lefevre | 415/119 |

FOREIGN PATENT DOCUMENTS

| | | | |
|---|---|---|---|
| EP | 0 573 895 | A1 | 12/1993 |
| EP | 1 291 570 | A2 | 3/2003 |
| JP | 123302 | | 9/1980 |
| JP | 57-049021 | | 3/1982 |
| SU | 665173 | A * | 5/1979 |
| WO | WO 9635879 | A1 * | 11/1996 |
| WO | WO 2005119031 | A1 * | 12/2005 |
| WO | WO 2005124159 | A1 * | 12/2005 |

OTHER PUBLICATIONS

A Fully Certified English Translation EP 0573895 Al, published on Dec. 15, 1993.*

* cited by examiner

*Primary Examiner* — Thai Ba Trieu
(74) *Attorney, Agent, or Firm* — Oblon, Spivak, McClelland, Maier & Neustadt, L.L.P.

(57) ABSTRACT

A device for turbocharging an internal combustion engine including a turbocompessor including a turbine driven by the engine exhaust gas and a compressor driven by the turbine and compresses the engine intake air. An air intake conduit connects the compressor output to an air intake manifold to the engine and includes a chamber for damping pulsations generated at the compressor output. The damping chamber is connected directly to the compressor output.

10 Claims, 2 Drawing Sheets

Prior Art

DEVICE FOR TURBOCHARGING AN INTERNAL COMBUSTING ENGINE COMPRISING A PULSATION DAMPING CHAMBER

BACKGROUND

The present invention relates to a turbocharger device of an internal combustion engine comprising a chamber for damping the pulsations generated at the outlet of the compressor.

A device of this type is described in particular in patent applications JP 57049021 and 12330280.

In these patent applications, a first damping chamber is situated mid-way on the air intake duct that connects the outlet of the compressor to the intake manifold of the engine.

Also, one or two other damping chambers are placed on ducts connected to the section of the intake duct lying between the compressor and the first damping chamber.

The chambers reduce the amplitude of the pressure pulsations in the intake duct by an interaction of damping and resonance effects.

FIGS. 1 and 2 appended illustrate the prior art closest to the invention.

In FIG. 1, reference number 1 indicates a turbocharger comprising a turbine 2 driven by the gases flowing in the exhaust duct 3 of the internal combustion engine 4.

The turbine 2 drives the rotor 5 of the compressor 6 which sends the compressed air into the intake duct 7 connected to the intake manifold 8 of the engine 4.

The intake duct 7 comprises on its path a chamber 9 whose structure is detailed in FIG. 2.

To make the intake duct 7 easier to install on the outlet endpiece 10 of the compressor 6, the end 11 of the duct 7 is attached around the endpiece 10 by snap-fitting means comprising a retaining clip 19.

The damping chamber 9 comprises a cylindrical external wall 12 which surrounds a cylindrical internal wall 13 whose diameter is substantially equal to that of the intake duct 7.

Between the cylindrical walls 12 and 13, two annular spaces 14 and 15 separated from one another by a partition 16 are created. Each space 14, 15 opens into the inside of the duct 7 through an annular slot 17, 18.

The damping chamber assembly is made of several elements welded together.

FIG. 2 shows in detail the snap-fitting of the end 11 of the intake duct 7 around the outlet endpiece 10 of the compressor 6.

The end 11 of the duct 7 has a shape that is flared toward the compressor comprising an annular shoulder 24 which rests on the end of a sleeve 23 that surrounds the outlet endpiece 10 of the compressor.

The flared end 11 of the duct 7 is snap-fitted to the sleeve 23 thanks to a retaining clip 19. Between the end 11 and the sleeve 23, seals 20, 21 are inserted.

BRIEF SUMMARY

The object of the present invention is to provide enhancements to the above known device by simplifying its construction while improving the effectiveness of the damping chamber.

According to the invention, the device for turbocharging an internal combustion engine comprising a turbocharger whose turbine is driven by the exhaust gases of the engine and whose compressor driven by this turbine compresses the engine intake air, the air intake duct linking the outlet of the compressor to the air intake manifold to the engine, comprising a chamber for damping the pulsations generated at the outlet of the compressor, is characterized in that said damping chamber is directly connected to the outlet of the compressor.

This arrangement makes it possible to simplify the construction while increasing the effectiveness of the damping chamber.

According to a preferred version of the invention, said damping chamber partially surrounds a tubular endpiece connected to the outlet of the compressor.

Preferably, said damping chamber comprises an external cylindrical wall and an internal wall between which two contiguous annular spaces are made and the internal wall of one of the annular spaces surrounds said outlet endpiece of the compressor.

This internal wall therefore forms the end of the intake duct which is adapted around the outlet endpiece of the compressor, which simplifies the construction of the device.

According to other particular features of the invention:

- said damping chamber comprises, in a radial plane situated substantially in its middle, a partition having a circular central opening whose diameter is substantially equal to the diameter of the tubular endpiece connected to the outlet of the compressor;
- said central opening is extended in a direction opposite to said endpiece by a tubular duct defining, with the external wall of said damping chamber, an annular space which opens toward the air intake duct via an annular opening formed between the free end of said tubular duct and the zone for connecting said chamber with the air intake duct;
- said damping chamber has another annular space in a zone extending between said annular partition and the zone for connecting said damping chamber with the outlet of the compressor;
- said other annular space opens radially toward the axis of the outlet endpiece of the compressor via a circular slot adjacent to the edge of said circular opening;
- the outlet endpiece of the compressor is surrounded annularly by a sleeve attached around the outlet of the compressor, the end of the external wall of the chamber opposite to the air intake duct being snap-fitted around said sleeve,
- said sleeve is surrounded by a tubular element one end of which comprises a rim resting on the outlet edge of said outlet endpiece and the other end of which is inserted between said outlet endpiece and the adjacent end of the external wall of the chamber and is attached to said sleeve by the means used to snap-fit the end of the external wall of the chamber to said sleeve.

BRIEF DESCRIPTION OF THE DRAWINGS

Other features and advantages of the invention will still appear in the following description.

In the appended drawings, given as nonlimiting examples.

DETAILED DESCRIPTION

Figure 1:
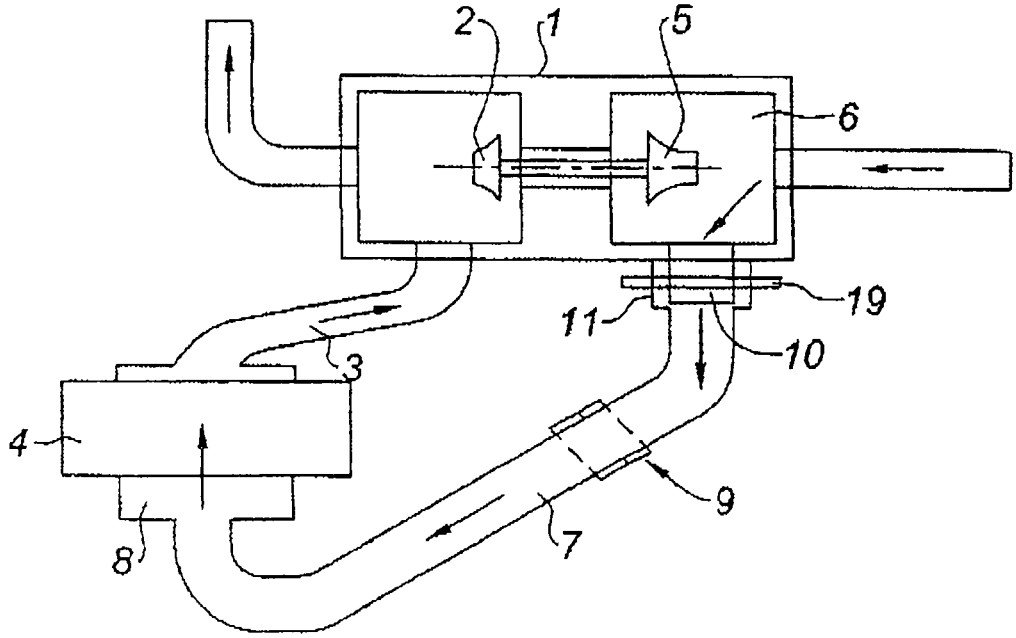
Fig. 1 Prior Art
FIG. 1 is a schematic view in longitudinal section of a turbocharger device comprising a known damping chamber.
Figure 3:
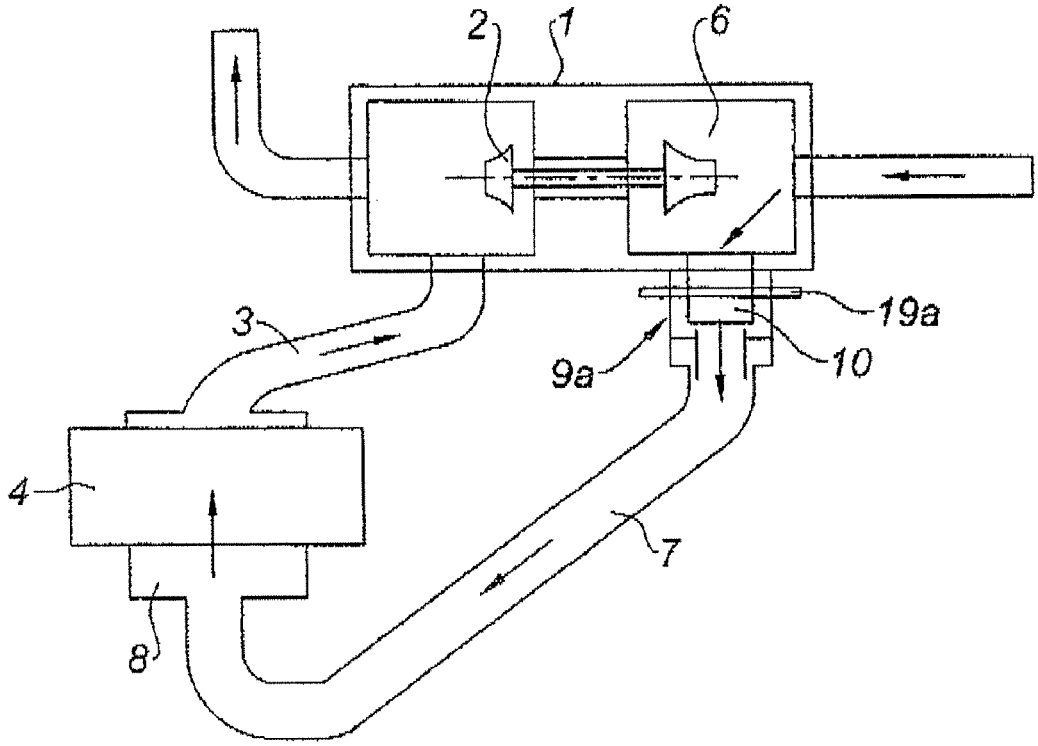
FIG. 3 is a view similar to FIG. 1 illustrating the device according to the invention.

In FIG. 3, the portions identical to those of FIG. 1 bear the same reference numbers.

As shown by this FIG. 3, the turbocharger device of an internal combustion engine 4 comprises a turbocompressor 1 whose turbine 2 is driven by the exhaust gases 3 of the engine 4 and whose rotor 5 of the compressor 6 driven by this turbine 2 compresses the intake air of the engine.

The air intake duct 7 connecting the outlet 10 of the compressor 6 to the air intake manifold 8 to the engine 4 comprises a chamber 9*a* for damping the pulsations generated at the outlet endpiece of the compressor 6.

According to the invention, this damping chamber 9*a* is directly connected to the outlet endpiece 10 of the compressor 6.

Figure 4:
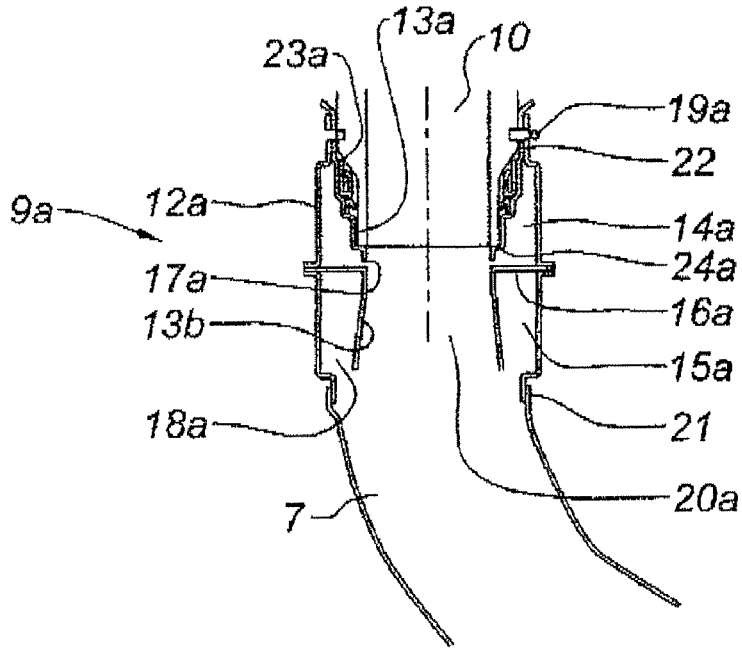
FIG. 4 is a view similar to FIG. 2, showing the damping chamber of the device according to the invention and its direct connection to the outlet of the compressor.

As can be seen in FIGS. 3 and 4, the damping chamber 9*a* partially surrounds the tubular endpiece 10 connected to the outlet of the compressor 6.

Figure 2:
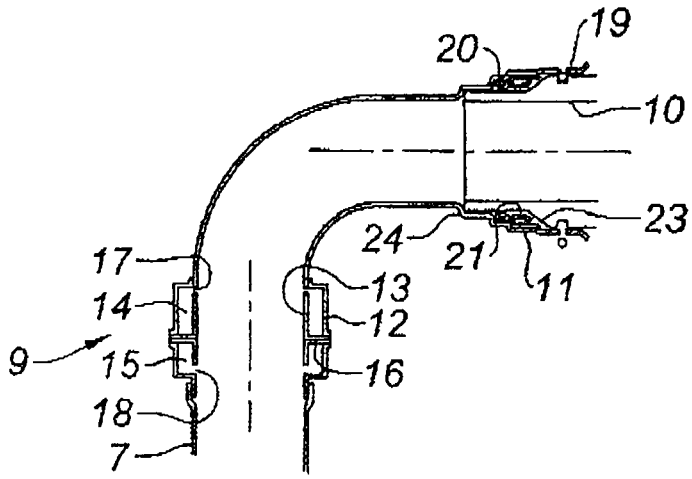
FIG. 2 is a partial view of the device according to FIG. 1, showing the detailed structure of the damping chamber and of the connection of the intake duct to the outlet of the compressor.

As in the case of FIGS. 1 and 2, the damping chamber 9*a* comprises an external cylindrical wall 12*a* and an internal wall 13*a*, 13*b* between which two contiguous annular spaces 14*a*, 15*a* are made.

In the case of FIGS. 3 and 4, the internal wall 13*a* of the annular space 14*a* almost entirely surrounds the outlet endpiece 10 of the compressor.

The damping chamber 9*a* comprises, in a radial plane situated substantially in its middle, a partition 16*a* having a circular central opening 20*a* whose diameter is substantially equal to the diameter of the outlet endpiece 10 connected to the outlet of the compressor.

This central opening 20*a* is extended in a direction opposite to the outlet endpiece 10 by a tubular duct 13*b* defining, with the external wall 12*a* of the damping chamber 9*a*, an annular space 15*a*.

This annular space 15*a* opens toward the air intake duct 7 via an annular opening 18*a* formed between the free end of the tubular duct 13*b* and the zone 21 for connecting the chamber 9*a* with the air intake duct 7.

FIG. 4 shows that the tubular duct 13*b* has a shape that is flared in the opposite direction from its central intake opening 20*a*.

Furthermore, the damping chamber 9*a* has an annular space 14*a* in a zone extending between the annular partition 16*a* and the zone 22 for connection of the damping chamber 9*a* with the outlet of the compressor.

The annular space 14*a* opens radially toward the axis of the outlet endpiece 10 of the compressor via a circular slot 17*a* adjacent to the edge of the circular opening 20*a* of the partition 16*a*.

FIG. 4 also shows that the outlet endpiece 10 of the compressor is surrounded annularly by a sleeve 23*a* attached around the outlet endpiece 10 of the compressor.

In addition, the end 22 of the external wall 12*a* of the chamber 9*a* opposite to the air intake duct 7 is snap-fitted around the sleeve 23*a*.

Furthermore, the sleeve 23*a* is surrounded by a tubular element which consists of the internal wall 13*a* of the internal space 14*a* of the chamber 9*a*.

One of the ends of this wall 13*a* comprises a rim 24*a* resting on the outlet edge of the outlet endpiece 10.

The other end of this wall 13*a* is inserted between the sleeve 23*a* and the adjacent end 22 of the external wall 12*a* of the chamber 9*a* and is attached to the sleeve 23*a* by the means comprising a clip 19*a* used to snap-fit the end of the external wall 12*a* of the chamber 9*a* to said sleeve 23*a*.

As in the case of FIG. 2, several seals are inserted between the wall 13*a* defining the space 14*a* and the sleeve 23*a*.

The main advantages of the device according to FIGS. 3 and 4 relative to that of FIGS. 1 and 2 are as follows:

It is less costly to produce mainly because the internal wall 13*a* of the chamber 9*a* is shaped to be able to be snap-fitted to the sleeve 23*a* which surrounds the outlet endpiece 10 of the compressor.

The internal wall 13*a* therefore has a dual function, because it replaces the two walls 13 and 11 of the device represented in FIGS. 1 and 2.

Furthermore, the other internal wall 13*b* of the chamber 9*a* can be produced in a single piece (as shown in FIG. 4) with the partition 16*a*, which saves on a weld.

In addition, because the damping chamber 9*a* is situated as close as possible to the compressor, an improvement of its effectiveness is noted and a reduction in the space requirement between the compressor and the intake manifold of the engine is obtained.

The invention claimed is:

1. A device for turbocharging an internal combustion engine, comprising:

a turbocharger including a turbine driven by exhaust gases of the engine and a compressor driven by the turbine that compresses engine intake air;

an air intake duct linking an outlet endpiece of the compressor to an air intake manifold to the engine; and a damping chamber for damping pulsations generated at the outlet endpiece of the compressor, the damping chamber comprising an external cylindrical wall, an internal wall, and a first annular space between the external cylindrical wall and the internal wall, wherein the internal wall surrounds the outlet endpiece of the compressor, wherein the first annular space surrounds the outlet endpiece and includes an opening positioned downstream from an outlet edge of the outlet endpiece, and wherein the damping chamber is directly connected to the outlet endpiece of the compressor.

2. The turbocharger device as claimed in claim 1, wherein the outlet endpiece of the compressor is tubular.

3. The turbocharger device as claimed in claim 1, wherein the damping chamber comprises, in a radial plane situated substantially in its middle, a partition having a circular central opening whose diameter is substantially equal to a diameter of the outlet endpiece of the compressor.

4. The turbocharger device as claimed in claim 3, wherein the central opening is extended in a direction opposite to the outlet endpiece by a tubular duct defining, with the external wall of the damping chamber, a second annular space, and the second annular space opens toward the air intake duct via an annular opening formed between a free end of the tubular duct and a zone for connecting the chamber with the air intake duct.

5. The turbocharger device as claimed in claim 4, wherein the tubular duct has a shape that is flared in the opposite direction to the circular central opening.

6. The turbocharger device as claimed in claim 4, wherein the first annular space is in a zone extending between the annular partition and the zone for connecting the damping chamber with the outlet endpiece of the compressor.

7. The turbocharger device as claimed in claim 6, wherein the first annular space opens radially toward an axis of the outlet endpiece of the compressor via a circular slot adjacent to an edge of the circular central opening.

8. The turbocharger device as claimed in claim 1, wherein the outlet endpiece of the compressor is surrounded annularly by a sleeve attached around the outlet endpiece of the compressor, an end of the external wall of the chamber opposite to the air intake duct being snap-fitted around the sleeve.

9. The turbocharger device as claimed in claim 8, wherein the sleeve is surrounded by a tubular element a first end of which comprises a rim resting on the outlet edge of the outlet endpiece and a second end of which is inserted between the outlet endpiece and the adjacent end of the external wall of the chamber and is attached to the sleeve by means used to snap-fit the end of the external wall of the chamber to the sleeve.

10. The turbocharger device as claimed in claim 9, wherein the means used to snap-fit the end of the external wall of the chamber to the sleeve is a clip.

* * * * *